US012578131B2

(12) United States Patent
Mandel et al.

(10) Patent No.: US 12,578,131 B2
(45) Date of Patent: Mar. 17, 2026

(54) COMPRESSOR OIL RECOVERY IN HYBRID VCC PUMPED TWO PHASE LOOPS

(71) Applicant: Hamilton Sundstrand Corporation, Charlotte, NC (US)

(72) Inventors: Raphael Mandel, West Hartford, CT (US); Ram Ranjan, San Diego, CA (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 114 days.

(21) Appl. No.: 18/506,768

(22) Filed: Nov. 10, 2023

(65) Prior Publication Data

US 2025/0155172 A1 May 15, 2025

(51) Int. Cl.
*F25B 43/02* (2006.01)
*F25B 1/04* (2006.01)

(52) U.S. Cl.
CPC ..... *F25B 43/02* (2013.01); *F25B 1/04* (2013.01); *F25B 2500/16* (2013.01)

(58) Field of Classification Search
CPC ..... F25B 43/02; F25B 1/04; F25B 2500/16; F25B 31/004; F25B 2500/28; F25B 31/001
See application file for complete search history.

(56) References Cited

U.S. PATENT DOCUMENTS 3,153,331 A 10/1964 Howard
3,681,934 A 8/1972 Tudury
4,136,528 A 1/1979 Vogel et al.
4,165,037 A 8/1979 Mccarson
4,259,848 A 4/1981 Voigt
4,554,799 A 11/1985 Pallanch
5,174,123 A 12/1992 Erickson
5,186,013 A 2/1993 Durso
5,575,833 A 11/1996 Griffin
6,330,800 B1 12/2001 Price et al.
6,820,434 B1 11/2004 Gutheim et al.
6,866,092 B1 3/2005 Molivadas
6,948,331 B1 9/2005 Ho
8,069,684 B2 12/2011 Heinbokel et al.
(Continued)

FOREIGN PATENT DOCUMENTS

AU 2021310128 A1 3/2023
EP 2629040 A2 8/2013
(Continued)

OTHER PUBLICATIONS

Extended European Search Report for EP Application No. 24204805.6, dated Feb. 11, 2025, 8 pages.
(Continued)

*Primary Examiner* — David J Teitelbaum
(74) *Attorney, Agent, or Firm* — Kinney & Lange, P.A.

(57) ABSTRACT

A cooling system includes a liquid loop, a vapor compression loop, and a heat exchanger in fluid communication with each of the liquid loop and the vapor compression cycle loop. The liquid loop includes a cold sink for cooling a heat load. The vapor compression cycle loop is fluidly coupled to the liquid loop by a separator, which is configured to separate a two-phase form of a working fluid received from the cold sink into a vapor form of the working fluid and a liquid form of the working fluid.

20 Claims, 3 Drawing Sheets

(56) References Cited

U.S. PATENT DOCUMENTS

| | | | | |
|---|---|---|---|---|
| 8,118,257 | B2 | 2/2012 | Wilmot et al. | |
| 8,297,065 | B2 | 10/2012 | Vaisman et al. | |
| 8,327,651 | B2 | 12/2012 | Finney et al. | |
| 8,429,921 | B2 | 4/2013 | Suharno et al. | |
| 9,109,840 | B2 | 8/2015 | Kadle et al. | |
| 9,482,451 | B2 | 11/2016 | Vaisman et al. | |
| 9,676,484 | B2 | 6/2017 | Vaisman et al. | |
| 9,719,699 | B2 | 8/2017 | Tamura et al. | |
| 9,851,130 | B2 | 12/2017 | Love et al. | |
| 10,088,202 | B2 | 10/2018 | Huff et al. | |
| 10,183,548 | B2 | 1/2019 | Enomoto et al. | |
| 10,288,325 | B2 | 5/2019 | Vaisman | |
| 10,399,683 | B2 | 9/2019 | Behrens et al. | |
| 10,408,508 | B2 | 9/2019 | Ronk et al. | |
| 10,479,170 | B2 | 11/2019 | Enomoto et al. | |
| 10,562,376 | B2 | 2/2020 | Miura et al. | |
| 10,746,177 | B2 | 8/2020 | Collins | |
| 10,746,440 | B2 | 8/2020 | Donovan et al. | |
| 10,842,044 | B2 | 11/2020 | Snyder | |
| 10,907,869 | B2 | 2/2021 | Hagh et al. | |
| 10,954,467 | B2 | 3/2021 | Rached | |
| 11,022,349 | B2 | 6/2021 | Perrotin | |
| 11,092,031 | B2 | 8/2021 | Frank et al. | |
| 11,162,388 | B1 | 11/2021 | Snyder et al. | |
| 11,215,383 | B2 | 1/2022 | Jansen | |
| 11,448,432 | B2 | 9/2022 | Vaisman et al. | |
| 11,466,907 | B2 | 10/2022 | Bandhauer et al. | |
| 11,530,844 | B2 | 12/2022 | Unton et al. | |
| 11,561,033 | B1 | 1/2023 | Vaisman et al. | |
| 11,629,890 | B1 | 4/2023 | Vaisman et al. | |
| 11,629,892 | B1 | 4/2023 | Vaisman et al. | |
| 11,692,779 | B2 | 7/2023 | Rockenfeller et al. | |
| 11,698,210 | B1 | 7/2023 | Vaisman et al. | |
| 11,725,858 | B1 | 8/2023 | Ladd | |
| 11,732,941 | B1 | 8/2023 | Vaisman et al. | |
| 11,744,042 | B2 | 8/2023 | Snyder | |
| 11,796,230 | B1 | 10/2023 | Vaisman et al. | |
| 11,892,208 | B2 | 2/2024 | Jansen | |
| 11,959,669 | B2 | 4/2024 | Unton et al. | |
| 11,988,418 | B2 | 5/2024 | Turney et al. | |
| 12,078,397 | B2 | 9/2024 | Zug | |
| 12,363,865 | B2 | 7/2025 | Khalili et al. | |
| 2002/0007641 | A1* | 1/2002 | Marsala | H01L 23/427 257/E23.098 |
| 2006/0162371 | A1 | 7/2006 | Lui et al. | |
| 2010/0083678 | A1 | 4/2010 | Lifson et al. | |
| 2011/0023514 | A1 | 2/2011 | Mitra et al. | |
| 2011/0048042 | A1 | 3/2011 | Chen et al. | |
| 2012/0011866 | A1 | 1/2012 | Scarcella et al. | |
| 2012/0023975 | A1 | 2/2012 | Yoon et al. | |
| 2012/0036854 | A1 | 2/2012 | Vaisman et al. | |
| 2012/0186290 | A1* | 7/2012 | Howes | B60H 1/32281 62/259.2 |
| 2013/0255289 | A1 | 10/2013 | Jung | |
| 2014/0202178 | A1* | 7/2014 | Trumbower | B60H 1/00278 62/509 |
| 2014/0326002 | A1 | 11/2014 | Sunderland et al. | |
| 2016/0138847 | A1 | 5/2016 | Zimmermann | |
| 2019/0314945 | A1 | 10/2019 | Jansen et al. | |
| 2019/0316818 | A1* | 10/2019 | Spangler | F25B 23/006 |
| 2019/0360730 | A1 | 11/2019 | Hagh et al. | |
| 2020/0113085 | A1* | 4/2020 | Schon | F25D 17/02 |
| 2021/0180851 | A1 | 6/2021 | Zha | |
| 2021/0318042 | A1 | 10/2021 | Molavi et al. | |
| 2022/0074633 | A1 | 3/2022 | Shu | |
| 2022/0099340 | A1* | 3/2022 | Unton | F25B 6/04 |
| 2022/0178602 | A1 | 6/2022 | Zug | |
| 2022/0205691 | A1 | 6/2022 | Spangler et al. | |
| 2022/0243961 | A1 | 8/2022 | Dong et al. | |
| 2023/0247795 | A1 | 8/2023 | Khalili et al. | |
| 2024/0118001 | A1 | 4/2024 | Ma et al. | |
| 2025/0067483 | A1 | 2/2025 | Sethi et al. | |
| 2025/0155172 | A1 | 5/2025 | Mandel et al. | |
| 2025/0189189 | A1 | 6/2025 | Mandel et al. | |
| 2025/0269724 | A1 | 8/2025 | Lynn et al. | |

FOREIGN PATENT DOCUMENTS

| | | | |
|---|---|---|---|
| EP | 3199456 | A1 | 8/2017 |
| EP | 3325898 | B1 | 5/2021 |
| EP | 4339531 | A1 | 3/2024 |
| GB | 2548123 | A | 9/2017 |
| PL | 213870 | B1 | 5/2013 |
| WO | 2018204184 | A1 | 11/2018 |

OTHER PUBLICATIONS

Partial European Search Report for EP Application No. 24207841.8, dated Apr. 22, 2025, 21 pages.

* cited by examiner

COMPRESSOR OIL RECOVERY IN HYBRID VCC PUMPED TWO PHASE LOOPS

BACKGROUND

The present disclosure is directed generally to cooling systems and more particularly to oil recovery for a compressor of a vapor compression cycle (VCC) with direct pumped two-phase cooling.

In a conventional two-fluid cooling cycle, indirect cooling of components is provided by a closed vapor compression cycle loop thermally connected to a liquid coolant loop as illustrated in FIG. 1. FIG. 1 shows two-fluid cooling cycle 100, which is configured to provide cooling to cold sink 102, which is thermally coupled to one or more components and/or fluids associated with the one or more components (illustrated as heat load 104) to provide cooling thereto. Cold sink 102 can be, for example, a cold plate having internal fluid passages for receiving a fluid of two-fluid cooling cycle 100, which absorbs heat from heat load 104.

Two-fluid cooling cycle 100 includes coolant loop 106 and refrigerant loop 108. In some configurations, two-fluid cooling cycle 100 may be described as a vapor cycle loop that is thermally connected to a liquid loop. Coolant loop 106 is a closed-loop system that includes cold sink 102, evaporator 110, and pump 112. Coolant loop 106 includes a coolant fluid, which can be continuously cycled through a closed-loop flow path through cold sink 102, evaporator 110, and pump 112. Coolant liquid passes through cold sink 102 where it picks up heat from heat load 104 and increases in temperature. The heated coolant enters evaporator 110 where excess heat is extracted and the coolant is cooled.

Refrigerant loop 108 includes evaporator 110, compressor 114, condenser 116, and expansion valve 118. Refrigerant loop 108 is a closed-loop system through which a refrigerant can be continuously cycled. Evaporator 110 is part of both coolant loop 106 and refrigerant loop 108. Evaporator 110 receives, as a first working fluid, the coolant of coolant loop 106 and, as a second working fluid, a refrigerant of refrigerant loop 108. The refrigerant picks up heat from the coolant of coolant loop 106 within evaporator 110 and enters a vapor phase. The refrigerant is supplied to compressor 114 as a saturated or superheated vapor, is cooled to a liquid state by condenser 116, is expanded to an evaporator pressure through expansion valve 118 and returned to evaporator 110 as a two-phase fluid where it will pick up heat and vaporize as it absorbs heat from the coolant of coolant loop 106.

The closed-loop system of two-fluid cooling cycle 100 allows for the use of compressors (e.g., scroll compressors) that require lubrication for operation. A lubricant is mixed with the refrigerant in refrigerant loop 108 which continuously cycles through compressor 114. While two-fluid cooling cycle 100 is capable of providing thermal management of temperature sensitive components, it does so at the expense of system efficiency, size, and weight due to the required components and inefficiencies thereof.

SUMMARY

A cooling system includes a liquid loop, a vapor compression loop, and a heat exchanger in fluid communication with each of the liquid loop and the vapor compression cycle loop. The liquid loop includes a cold sink for cooling a heat load. The vapor compression cycle loop is fluidly coupled to the liquid loop by a separator, which is configured to separate a two-phase form of a working fluid received from the cold sink into a vapor form of the working fluid and a liquid form of the working fluid.

A method of recovering a lubricant in a hybrid vapor compression cooling system includes separating, by a separator, a vapor form of a working fluid from a liquid form of a working fluid, wherein the working fluid comprises the lubricant and wherein the lubricant is preferentially separated with the liquid form of the working fluid; delivering the liquid form of the working fluid from the separator to a liquid loop, the liquid loop comprising a pump and a cold sink fluidly coupled in flow series, the cold sink in fluid communication with a separator inlet; delivering the vapor form of the working fluid from the separator to a vapor compression cycle loop, the vapor compression cycle loop comprising a compressor, a condenser, and an expansion valve fluidly coupled in flow series, the expansion valve fluidly coupled to a separator inlet; delivering a first portion of the working fluid in the liquid loop to the cold sink; and delivering a second portion of the working fluid in the liquid loop to the vapor compression cycle loop.

The present summary is provided only by way of example, and not limitation. Other aspects of the present disclosure will be appreciated in view of the entirety of the present disclosure, including the entire text, claims and accompanying figures.

Figure 1:
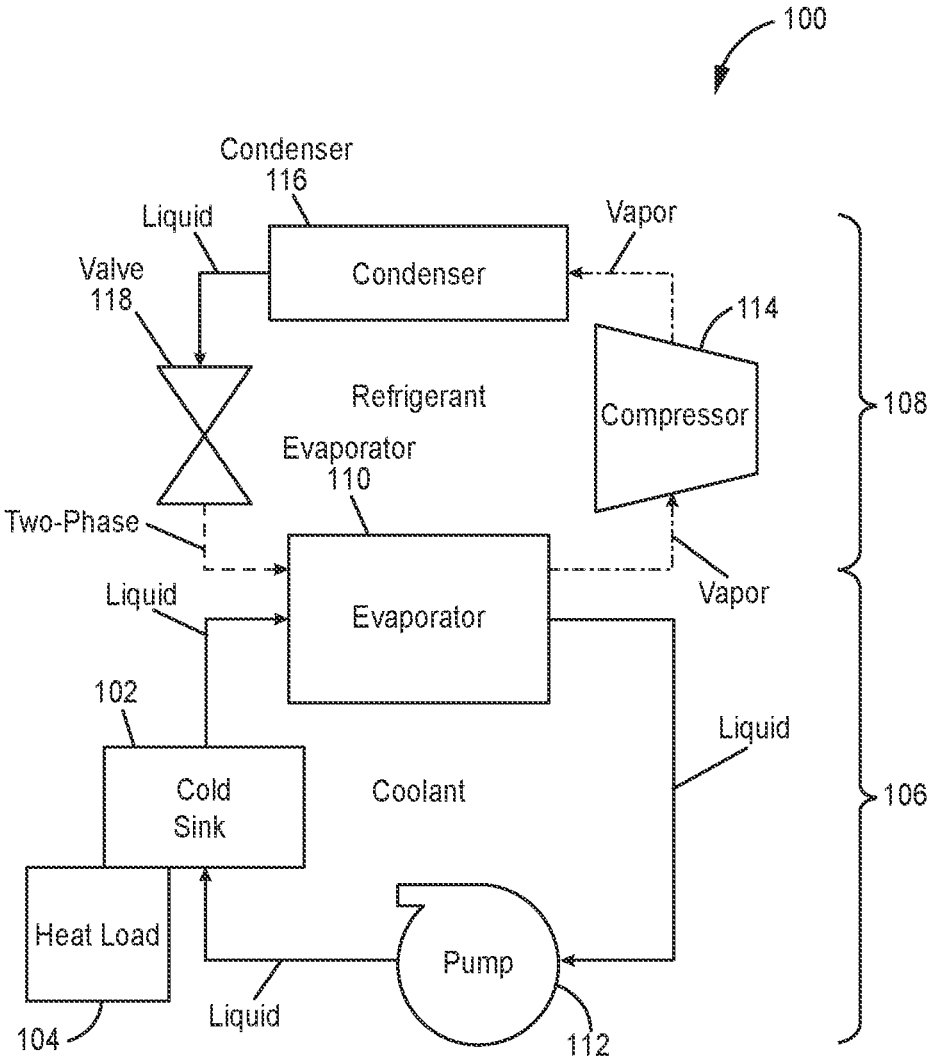
FIG. 1 (Prior Art)
FIG. 1 is a schematic illustration of a conventional two-fluid cooling system.

While the above-identified figures set forth embodiments of the present invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features, steps and/or components not specifically shown in the drawings.

DETAILED DESCRIPTION

Figure 2:
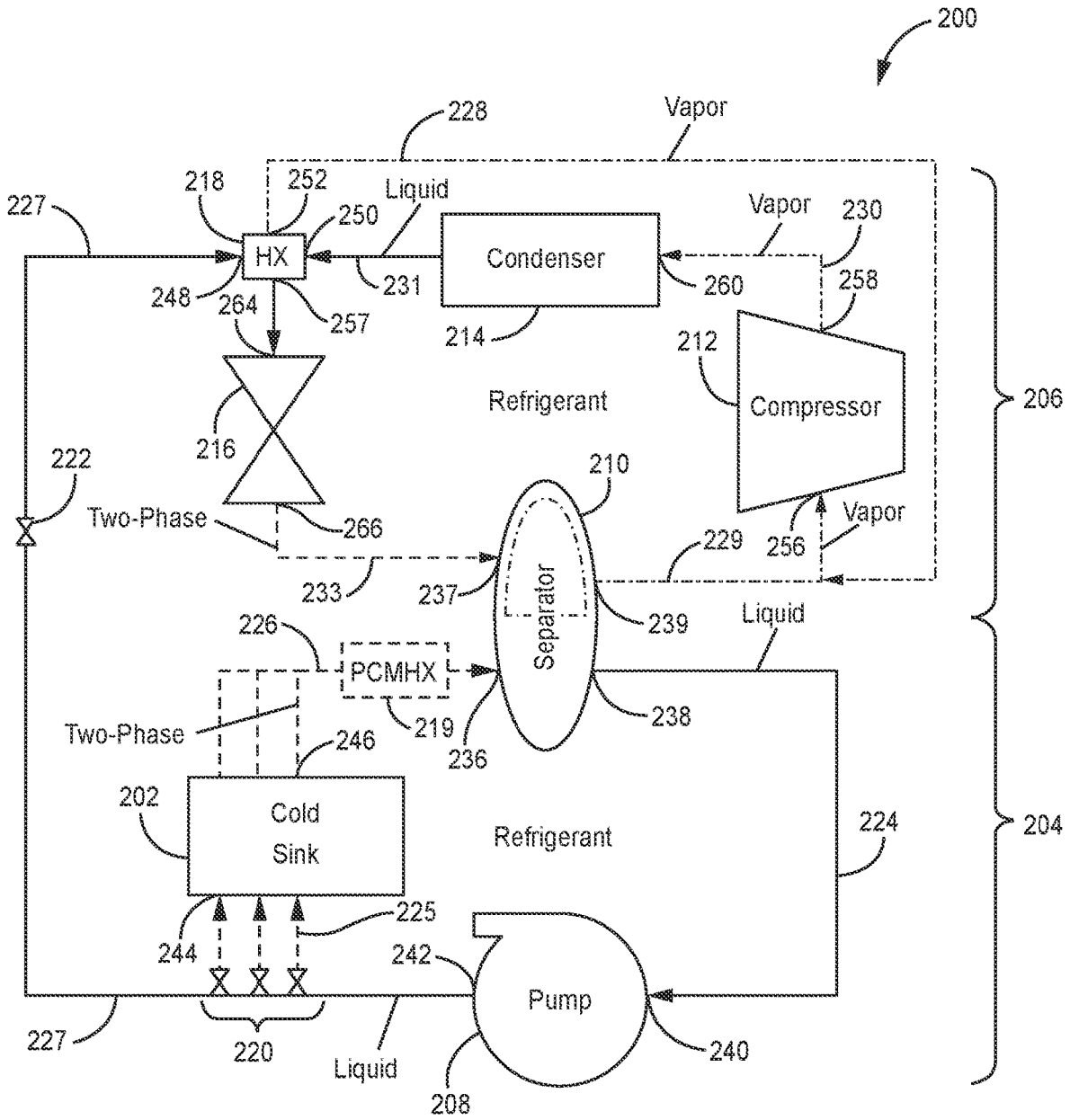
FIG. 2 is a schematic illustration of a single fluid cooling system in accordance with an embodiment of the present disclosure.
Figure 3:
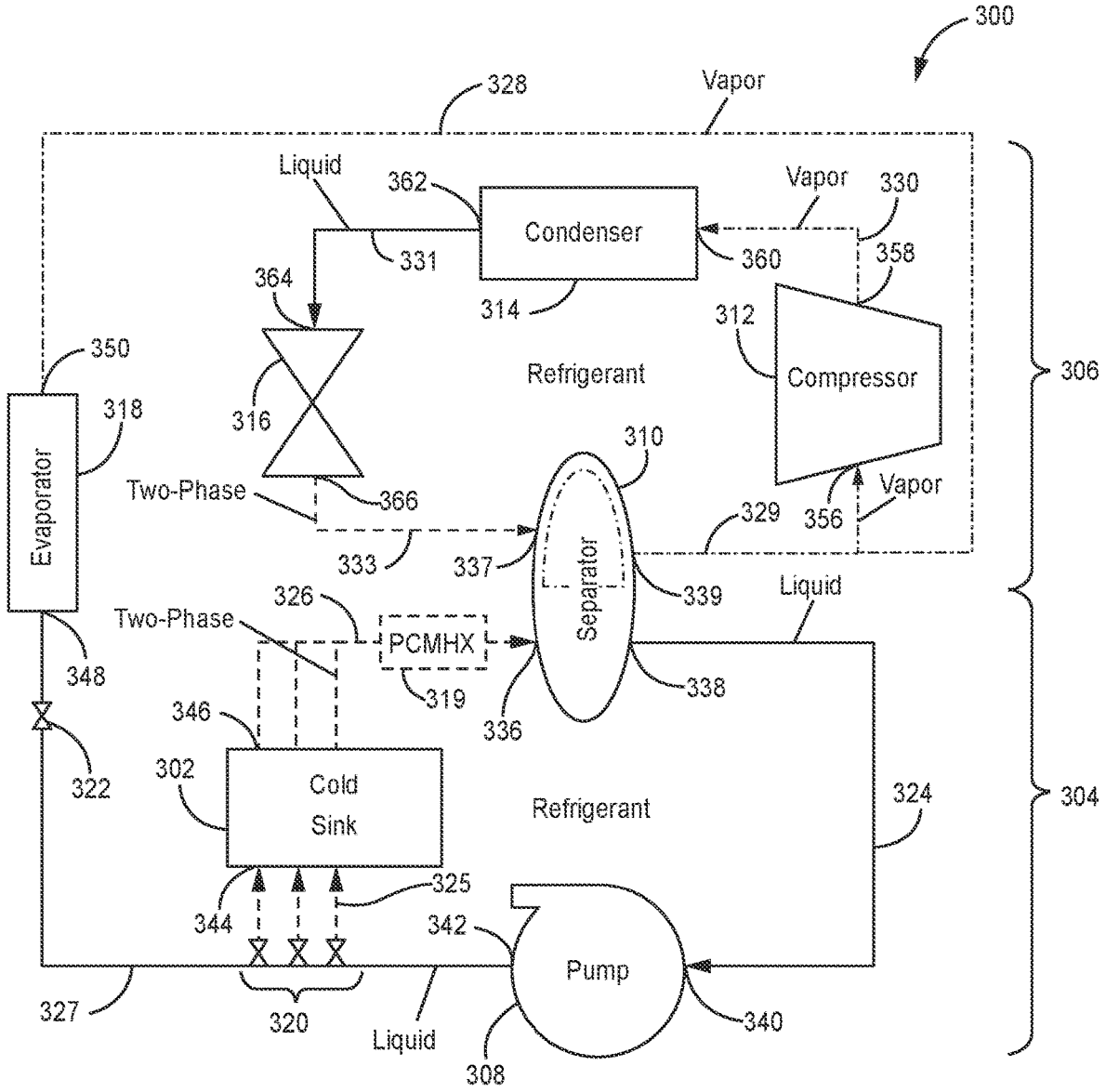
FIG. 3 is a schematic illustration of a single fluid cooling system in accordance with another embodiment of the present disclosure.

FIG. 2 is a schematic illustration of single-fluid, two-phase cooling system 200. FIG. 3 is a schematic illustration of single-fluid, two-phase cooling system 300. Systems 200 and 300 are hybrid vapor compression cycle (VCC) with direct pumped two-phase refrigerant loops that are lighter weight and more efficient than the indirect cooling provided by two-fluid cooling cycle 100 shown in FIG. 1. As described further herein, systems 200 and 300 obtain these advantages by replacing evaporator 110 of two-fluid cooling cycle 100 with a separator, which requires no temperature difference to drive heat transfer or surface area for heat transfer. As further described herein, systems 200 and 300 are configured to allow a lubricant to be continuously cycled with a working fluid through the VCC loop enabling the use of compressors (e.g., scroll compressors) that require lubrication for operation.

Systems 200 and 300 are configured to operate with a single working fluid (refrigerant), which is supplied to a cold sink 202, 302 (e.g., cold plates) that can be thermally coupled to one or more heat loads (not shown) to provide cooling thereto. Heat loads can be, for example and without limitations, power electronics, electronic devices, a working fluid line of a cooling loop/cycle, or the like, and/or portions thereof as will be appreciated by those of skill in the art.

The working fluid used in systems 200 and 300 can be a refrigerant, for example and without limitation, 1,1,1,2-Tetrafluoroethane (R-134a) or 2,3,3,3-Tetrafluoropropene (R-123yf). Other refrigerants may be used without departing from the scope of the present disclosure. The working fluid is cycled through systems 200 and 300 as a liquid, two-phase fluid, and saturated vapor as shown in FIGS. 2 and 3.

FIG. 2 shows system 200, cold sink 202, pumped two-phase loop (referred to hereinafter as "liquid loop") 204, VCC loop (referred to herein after as "vapor loop") 206, pump 208, separator 210, compressor 212, condenser 214, expansion valve 216, heat exchangers 218, 219, metering elements 220 and 222, fluid lines 224-233, separator inlets 236, 237 and outlets 238, 239, pump inlet 240 and outlet 242, cold sink inlet 244 and outlet 246, heat exchanger inlets 248, 250 and outlets 252 and 254, compressor inlet 256 and outlet 258, condenser inlet 260 and outlet 262, and expansion valve inlet 264 and outlet 266. Fluid lines 224-233 schematically illustrate the flow of fluid between components of system 200 and do not necessarily represent the arrangement of fluid conduits. For example, some of fluid lines 224-233 may be combined in a single conduit upstream or downstream of a component. Likewise, labelling of inlets and outlets of components of system 200 is provided merely to illustrate a direction of fluid flow and is not intended to limit the invention. Liquid loop 204 includes pump 208, cold sink 202, and separator 210. In some embodiments, liquid loop 204 can include heat exchanger 219. Vapor loop 206 includes separator 210, compressor 212, condenser 214, and expansion valve 216. Liquid loop 204 is fluidly coupled to vapor loop 206 via separator 210 and via compressor 212 through heat exchanger 218. System 200 can include additional components not shown as may be required for thermal management and/or fluid control. The terms "fluidly coupled" and "in fluid communication" are used interchangeably herein and denote an ability to transfer fluid therebetween.

As illustrated in FIG. 2, separator 210 is arranged downstream of expansion valve 216 and cold sink 202. Separator 210 is arranged upstream of compressor 212 and pump 208. Pump 208 and a cold sink 202 are fluidly coupled in flow series. Cold sink 202 is arranged downstream of pump 208. Compressor 212, condenser 214, and expansion valve 216 are fluidly coupled in flow series. Compressor 212 is arranged downstream of each of separator 210 and heat exchanger 218 and is arranged upstream of condenser 214. Condenser 214 is arranged downstream of compressor 212 and upstream of heat exchanger 218. Heat exchanger 218 is arranged upstream of each of compressor 212 and expansion valve 216. Heat exchanger 218 is arranged downstream of each of condenser 214 and pump 208. Pump 208 is arranged downstream of separator 210 and upstream of each of cold sink 202 and heat exchanger 218. Cold sink 202 is arranged upstream of separator 210. Heat exchanger 219 can be arranged along liquid loop 206 between cold sink 202 and separator 210.

Within liquid loop 204, outlet 238 of separator 210 is fluidly coupled to inlet 240 of pump 208, as shown by fluid line 224. Outlet 242 of pump 208 is fluidly coupled to one or more inlets 244 of cold sink 202 via one or more metering elements 220, as illustrated by fluid line 225. One or more outlets 246 of cold sink 202 are fluidly coupled to inlet 236 of separator 210, as illustrated by fluid line 226. Outlet 242 of pump 208 is additionally fluidly coupled to vapor loop 206 via heat exchanger 218. Outlet 242 of pump 208 is fluidly coupled to inlet 248 of heat exchanger 218, as illustrated by fluid line 227. Outlet 252 of heat exchanger 218 is fluidly coupled to inlet 256 of compressor 212 of vapor loop 206, as illustrated by fluid line 228.

Within vapor loop 206, outlet 239 of separator 210 is fluidly coupled to inlet 256 of compressor 212, as illustrated by fluid line 229. Outlet 258 of compressor 212 is fluidly coupled to inlet 260 of condenser 214, as illustrated by fluid line 230. Outlet 262 of condenser 214 is fluidly coupled to inlet 250 of heat exchanger 218, as illustrated by fluid line 231. Outlet 254 of heat exchanger 218 is fluidly coupled to inlet 264 of expansion valve 216, as illustrated by fluid line 232. Inlet 250 of heat exchanger 218 is fluidly coupled to outlet 254 of heat exchanger. Inlet 250 and outlet 254 of heat exchanger 218 are fluidly separated from inlet 248 and outlet 252 of heat exchanger 218. Outlet 266 of expansion valve 216 is fluidly coupled to inlet 237 of separator 210, as illustrated by fluid line 233. In some embodiments, inlets 236 and 237 of separator can be a single inlet fed by fluid lines 226 and 233, which can be combined upstream of separator 210.

The flow of fluid (liquid, two-phase, and vapor) between components of system 200 is illustrated by arrows. As previously discussed, system 200 utilizes a single working fluid (e.g., refrigerant) and separator 210, which divides the flows of working fluids (vapor and liquid) between liquid loop 204 and vapor loop 206.

Separator 210 receives the working fluid in the two-phase state from cold sink 202 of liquid loop 204 and expansion valve 216 of vapor loop 206. The two-phase working fluid is separated into liquid and vapor components within separator 210. The liquid portion of the working fluid is delivered to liquid loop 206 for cooling a thermal load in thermal communication with cold sink 202. The vapor portion of the working fluid is directed to vapor loop 206 wherein it is returned to a two-phase state via compressor 212, condenser 214, and expansion valve 216.

Separator 210 may be a gravity driven component configured to separate the denser liquid phase from the less dense gaseous vapor phase. Compressor 212 arranged downstream of separator 210 can pull the vapor phase of the working fluid out of separator 210 while gravity acts to pull the liquid portion of the working fluid away from the vapor portion of the working fluid. Pump 208, arranged downstream of separator 210, may be used to aid in pulling the liquid working fluid from separator 210 through liquid loop 204. It will be appreciated that separator 210 is not limited to a gravity-type separator. For example, centrifugal gas-liquid separators may be used without departing from the scope of the present disclosure.

The liquid portion of the working fluid received in liquid loop 204 from separator 210 is increased in pressure through pump 208 and provided to cold sink 202 for cooling purposes. The working fluid within liquid loop 406 is maintained in liquid form as it enters cold sink 202, which may include pressure regulating elements associated with each heat load that is thermally coupled to cold sink 202.

In some embodiments, an inlet manifold associated with the cold sink 202 may be arranged between the pump 208 and cold sink 202 to receive the liquid working fluid. Similarly, a downstream outlet manifold may be arranged at the downstream end of cold sink 202 to receive and combine the working fluid as it exits cold sink 202. The working fluid may be in liquid form, two-phase form, or vapor form as it exits the cooling sink 202. The working fluid can be joined with the fluid from vapor loop 206 before, at, or in separator 210.

Heat exchanger 219 can be a thermal energy storage device arranged in liquid loop 204 between cold sink 202 and separator 210. Heat exchanger 219 can be, for example and without limitation, a phase change heat exchanger (PCMHX).

A vapor portion of the working fluid within separator 210 is directed into vapor loop 206. The vapor portion of the working fluid is compressed by compressor 212 and then condensed to a liquid state within condenser 214. Condenser 214 can be fluidly coupled to a ram air duct of an aircraft. The liquid working fluid is directed through a first flow path of heat exchanger 218 where it can heat liquid working fluid received from pump 208 in a separate flow path. The resulting cooled liquid working fluid is then expanded into a two-phase state by expansion valve 216. The two-phase fluid from each of liquid loop 204 and the vapor loop 206 are received by separator 210.

Compressor 212 is lubricated using a lubricant (e.g., oil) suspended in the working fluid of system 200. Lubricant entrained in the two-phase fluid entering separator 210 from expansion valve 216 and cold sink 202 is preferentially separated with the liquid portion of the working fluid separated in separator 210 and delivered to liquid loop 204. As such, compressor 212 may receive insufficient amounts of lubricant from separator 210 to maintain operation. Over time, compressor 212 loses lubrication due to accumulation of lubricant in liquid loop 204 without replacement. To prevent lubricant from accumulating in liquid loop 204, a portion of lubricant laden liquid working fluid exiting pump 208 in liquid loop 204 is pumped through heat exchanger 218 where it is vaporized and fed directly into compressor 212 downstream of separator 210. The lubricant is entrained in the vaporized fluid and can lubricate compressor 212 during operation.

Heat exchanger 218 places the liquid working fluid with lubricant received from pump 208 in liquid loop 204 in thermal communication with the liquid working fluid received from condenser 214 in vapor loop 206. Heat exchanger 218 can be for example and without limitation, a shell and tube heat exchanger or other liquid-to-liquid heat exchanger known in the art. The liquid working fluid received in heat exchanger 218 from condenser 214 heats the liquid working fluid received in heat exchanger 218 from pump 208 to convert the liquid working fluid received from pump 208 to a vapor phase suitable for delivery to and operation of compressor 212. The vaporized working fluid exiting heat exchanger 218 (via outlet 252) can be combined with the vaporized working fluid exiting separator (via outlet 239) upstream of or at an inlet of compressor 212. Since cooling is applied to the liquid working fluid received from condenser 214 in vapor loop 206, the efficiency of the cycle is not significantly reduced. Heat exchanger 218 is arranged between condenser 214 and expansion valve 216 such that the cooled liquid working fluid is received by expansion valve 216. Lubricant entrained in the vaporized working fluid delivered to compressor 212 cycles through vapor loop 206 and is returned to liquid loop 204 via separator 210.

The amount of lubricant delivered to compressor 212 can be determined by the amount of liquid working fluid directed from pump 208 to heat exchanger 218. Flow of liquid working fluid from pump 208 is split between cold sink 202 and heat exchanger 218. One or more metering elements 220 disposed in fluid line 225 and in fluid communication with fluid line 227 can meter fluid flow of working fluid delivered to cold sink 202. Metering element 222 disposed in fluid line 227 can modulate fluid flow or change a volume of working fluid delivered to heat exchanger 218. The volume of working fluid delivered to heat exchanger 218 can be set based on a lubricant load (amount of lubricant in the working fluid) and a predetermined lubricant demand for operation of compressor 212. In some embodiments, the lubricant load can be increased over lubricant loads of a conventional refrigerant system to reduce the amount of liquid working fluid delivered to heat exchanger 218 and thereby increase the amount of working fluid available for cooling via cold sink 202.

One or both metering elements 220 and 222 can be a valve electronically controlled by a controller (not shown). One or both metering elements 220 and 222 can be controlled to modulate fluid flow to heat exchanger 218 and cold sink 202 based on lubricant load and the predetermined lubricant demand for operation of compressor 212.

System 300 shown in FIG. 3 is substantially similar to system 200 but replaces heat exchanger 218 with evaporator 318 to vaporize a portion of lubricant laden liquid working fluid received from liquid loop 304 for delivery to vapor loop 304. FIG. 3 shows system 300, cold sink 302, liquid loop 304, vapor loop 306, pump 308, separator 310, compressor 312, condenser 314, expansion valve 316, evaporator 318, heat exchanger 319, metering elements 320 and 322, fluid lines 324-332, separator inlets 336, 337 and outlets 338, 339, pump inlet 340 and outlet 342, cold sink inlet 344 and outlet 346, evaporator inlet 348 and outlet 350, compressor inlet 356 and outlet 358, condenser inlet 360 and outlet 362, and expansion valve inlet 364 and outlet 366. Fluid lines 324-332 schematically illustrate the flow of fluid between components of system 300 and do not necessarily represent the arrangement of fluid conduits. For example, some of fluid lines 324-332 may be combined in a single conduit upstream or downstream of a component. Likewise, labelling of inlets and outlets of components of system 300 is provided merely to illustrate a direction of fluid flow and is not intended to limit the invention. Liquid loop 304 includes pump 308, cold sink 302, and separator 310. In some embodiments, liquid loop 304 can include heat exchanger 319. Vapor loop 306 includes separator 310, compressor 312, condenser 314, and expansion valve 316. Liquid loop 304 is fluidly coupled to vapor loop 306 via separator 310 and via compressor 312 through evaporator 318. System 300 can include components not shown as may be required for thermal management and/or fluid control.

As illustrated in FIG. 3, separator 310 is arranged downstream of expansion valve 316 and cold sink 302. Separator 310 is arranged upstream of compressor 312 and pump 308. Compressor 312 is arranged downstream of separator 310 and heat exchanger 318 and arranged upstream of condenser 314. Condenser 314 is arranged downstream of compressor 312 and upstream of expansion valve 316. Evaporator 318 is arranged upstream of compressor 312. Evaporator 318 is arranged downstream of pump 308. Pump 308 is arranged downstream of separator 310 and upstream of cold sink 302 and evaporator 318. Cold sink 302 is arranged upstream of separator 310. Heat exchanger 319 can be arranged along liquid loop 306 between cold sink 302 and separator 310.

Within liquid loop 304, outlet 338 of separator 310 is fluidly coupled to inlet 340 of pump 308 as shown by fluid line 324. Outlet 342 of pump 308 is fluidly coupled to one or more inlets 344 of cold sink 302 via one or more metering elements 320 as illustrated by fluid line 325. One or more outlets 346 of cold sink 302 are fluidly coupled to inlet 336 of separator 310 as illustrated by fluid line 326. Outlet 342 of pump 308 is additionally fluidly coupled to vapor loop 306 via evaporator 318. Outlet 342 of pump 308 is fluidly coupled to inlet 348 of evaporator 318 as illustrated by fluid line 327. Outlet 350 of evaporator 318 is fluidly coupled to inlet 352 of compressor 312 of vapor loop 306 as illustrated by fluid line 328.

Within vapor loop 306, outlet 339 of separator 310 is fluidly coupled to inlet 356 of compressor 312 as illustrated by fluid line 329. Outlet 358 of compressor 312 is fluidly coupled to inlet 360 of condenser 314 as illustrated by fluid line 330. Outlet 362 of condenser 314 is fluidly coupled to inlet 364 of expansion valve 316 as illustrated by fluid line 331. Outlet 366 of expansion valve 316 is fluidly coupled to inlet 337 of separator 310 as illustrated by fluid line 332. In some embodiments, inlets 336 and 337 of separator can be a single inlet fed by fluid lines 326 and 332, which can be combined upstream of separator 310.

The flow of fluid (liquid, two-phase, and vapor) between components of system 300 is illustrated by arrows. As previously discussed, system 300 utilizes a single fluid (e.g., refrigerant) and separator 310, which divides the flows of fluids of the refrigerant (vapor and liquid) between liquid loop 304 and vapor loop 306.

Components of system 300 operate in substantially the same way as similar components of system 200 described with respect to FIG. 2. System 300 does not include heat exchanger 218 of system 200. Heat exchanger 218 is replaced with evaporator 318 in system 300. Evaporator 318 of system 300 is configured to provide the same function as heat exchanger 218 of system 200. Specifically, evaporator 318 is configured to vaporize the lubricant laden working fluid of liquid loop 204 received from pump 308 to produce a vaporized working fluid suitable for delivery to compressor 312 and including entrained lubricant for lubrication of compressor 312 during operation. Whereas system 200 utilizes heat from liquid working fluid exiting condenser 214 of vapor loop 206 for vaporizing lubricant laden liquid working fluid received from liquid loop 204, system 300 is configured for operation with an external heat load (not shown).

Evaporator 318 is a heat exchanger. Evaporator 318 places the liquid working fluid with lubricant received from pump 308 in liquid loop 304 in thermal communication with a heat load (e.g., electronics) requiring cooling. Thermal energy is transferred from the heat load to the liquid working fluid received in evaporator 318 from pump 308 to convert the liquid working fluid received from pump 308 to a vapor phase suitable for delivery to and operation of compressor 312. The vaporized working fluid exiting evaporator 318 (via outlet 350) can be combined with the vaporized working fluid exiting separator (via outlet 339) upstream of or at an inlet of compressor 312. Lubricant entrained in the vaporized working fluid delivered to compressor 312 cycles through vapor loop 306 and is returned to liquid loop 304 via separator 310.

Although a specific type of heat exchanger (evaporator 318) is described, those of skill in the art will appreciate that embodiments of the present disclosure may incorporate other types of heat exchangers thermally coupled to a heat load without departing from the scope of the present disclosure.

The amount of lubricant delivered to compressor 312 can be determined by the amount of liquid working fluid directed from pump 308 to evaporator 318. Flow of liquid working fluid from pump 308 is split between cold sink 302 and evaporator 318. One or more metering elements 320 disposed in fluid line 325 and in fluid communication with fluid line 327 can meter fluid flow of working fluid delivered to cold sink 302. Valve 322 disposed in fluid line 327 can modulate fluid flow or change a volume of working fluid delivered to evaporator 318. The volume of working fluid delivered to evaporator 318 can be set based on a lubricant load and a predetermined lubricant demand for operation of compressor 312. As described with respect to system 200, in some embodiments, the lubricant load can be increased over lubricant loads of a conventional refrigerant system to reduce the amount of liquid working fluid delivered to evaporator 318 and thereby increase the amount of working fluid available for cooling via cold sink 302.

One or both metering elements 320 and 322 can be a valve electronically controlled by a controller (not shown), and one or both metering elements 320 and 322 can be controlled to modulate fluid flow to heat exchanger 318 and cold sink 302 based on a lubricant load of the refrigerant and the predetermined lubricant demand for operation of compressor 312.

Advantageously, embodiments disclosed herein provide for improved efficiency cooling systems and cycles. Embodiments of the present disclosure provide for single-fluid, multi-phase cooling systems that efficiently separate liquid and vapor loops to reduce inefficiencies introduced by having a multi-phase fluid in such cooling cycles. The addition of the disclosed heat exchanger or evaporator to deliver vaporized working fluid with entrained lubricant to the compressor of the vapor loop enables the single-fluid, two-phase cooling cycle to operate with compressors, such as scroll compressors, that require lubrication to function.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

Discussion of Possible Embodiments

The following are non-exclusive descriptions of possible embodiments of the present invention.

A cooling system includes a liquid loop, a vapor compression loop, and a heat exchanger in fluid communication with each of the liquid loop and the vapor compression cycle loop. The liquid loop includes a cold sink for cooling a heat load. The vapor compression cycle loop is fluidly coupled to the liquid loop by a separator, which is configured to separate a two-phase form of a working fluid received from the cold sink into a vapor form of the working fluid and a liquid form of the working fluid.

The cooling system of the preceding paragraph can optionally include, additionally and/or alternatively, any one or more of the following features, configurations and/or additional components:

In an embodiment of the preceding cooling system, each of the cold sink and the heat exchanger can be disposed to receive a liquid form of the working fluid from the separator.

In an embodiment of any of the preceding cooling systems, the liquid loop can further include a pump disposed in fluid communication between the separator outlet and each of a cold plate inlet and a heat exchanger inlet.

In an embodiment of any of the preceding cooling systems, the liquid loop can further include a first fluid metering element disposed in a fluid line fluidly coupling the cold sink inlet and a pump outlet, the first fluid metering element configured to meter a flow of the working fluid delivered to the cold sink.

In an embodiment of any of the preceding cooling systems, the liquid loop can further include a second fluid metering element disposed in a fluid line fluidly coupling the heat exchanger inlet and the pump outlet, the second fluid metering element configured to meter a flow of the working fluid delivered to the heat exchanger.

In an embodiment of any of the preceding cooling systems, at least one of the first and second fluid metering elements can be an electronically controlled valve.

In an embodiment of any of the preceding cooling systems, the vapor compression cycle loop can include a compressor, the compressor fluidly coupled to a heat exchanger outlet and the separator outlet to receive a vapor form of the working fluid from each of the heat exchanger and the separator.

In an embodiment of any of the preceding cooling systems, the heat exchanger can be configured to provide thermal communication between the working fluid in the liquid loop and the working fluid in the vapor compression cycle loop.

In an embodiment of any of the preceding cooling systems, the vapor compression cycle loop can further include a condenser disposed downstream of the compressor and an expansion valve disposed downstream of the condenser and upstream of the separator. The heat exchanger is disposed between the condenser and the expansion valve and configured to place the working fluid received from the condenser in thermal communication with the working fluid received from the pump.

In an embodiment of any of the preceding cooling systems, the vapor compression cycle loop can further include a condenser disposed downstream of the compressor and an expansion valve disposed downstream of the condenser and upstream of the separator. The heat exchanger is configured to place the working fluid received from the pump in thermal communication with a heat load external to the vapor compression cycle loop.

In an embodiment of any of the preceding cooling systems, the heat exchanger can be an evaporator.

In an embodiment of any of the preceding cooling systems, the working fluid comprises a refrigerant and a lubricant.

In an embodiment of any of the preceding cooling systems, the separator can be configured to preferentially separate the lubricant from the vapor form of the working fluid and deliver the lubricant in the liquid form of the working fluid to the liquid loop.

In an embodiment of any of the preceding cooling systems, each of the heat exchanger and the cold plate can be arranged to receive a portion of the working fluid from the pump.

In an embodiment of any of the preceding cooling systems, the heat exchanger can be configured to place the working fluid received from the pump in thermal communication with a heat sink to vaporize the working fluid received from the pump.

A method of recovering a lubricant in a hybrid vapor compression cooling system includes separating, by a separator, a vapor form of a working fluid from a liquid form of a working fluid, wherein the working fluid comprises the lubricant and wherein the lubricant is preferentially separated with the liquid form of the working fluid; delivering the liquid form of the working fluid from the separator to a liquid loop, the liquid loop comprising a pump and a cold sink fluidly coupled in flow series, the cold sink in fluid communication with a separator inlet; delivering the vapor form of the working fluid from the separator to a vapor compression cycle loop, the vapor compression cycle loop comprising a compressor, a condenser, and an expansion valve fluidly coupled in flow series, the expansion valve fluidly coupled to a separator inlet; delivering a first portion of the working fluid in the liquid loop to the cold sink; and delivering a second portion of the working fluid in the liquid loop to the vapor compression cycle loop.

The method of the preceding paragraph can optionally include, additionally and/or alternatively, any one or more of the following features, configurations, additional components, and/or steps:

In an embodiment of the preceding method, delivering the second portion of the working fluid to the vapor compression cycle loop can include delivering the second portion of the working fluid to a heat exchanger upstream of the compressor of the vapor compression cycle loop.

In an embodiment of any of the preceding methods, the heat exchanger places the second portion of the working fluid in thermal communication with a heat load to vaporize the second portion of the working fluid.

In an embodiment of any of the preceding methods, the heat exchanger places the second portion of the working fluid in thermal communication with working fluid received from the condenser of the vapor compression cycle loop to vaporize the second portion of the working fluid.

In an embodiment of any of the preceding methods, controlling a volume of the second portion of the working fluid based on a lubricant load and a predetermined lubricant demand for operation of the compressor.

The invention claimed is:

1. A cooling system comprising:

a liquid loop comprising a cold sink for cooling a heat load;

a vapor compression cycle loop fluidly coupled to the liquid loop by a separator, the separator configured to separate a two-phase form of a working fluid received from the cold sink into a vapor form of the working fluid and a liquid form of the working fluid;

a heat exchanger in fluid communication with each of the liquid loop and the vapor compression cycle loop;

a pump disposed in fluid communication between a separator outlet and each of a cold sink inlet and a heat exchanger inlet; and a first fluid metering element disposed in a fluid line fluidly coupling the cold sink inlet and a pump outlet, the first fluid metering element configured to meter a flow of the working fluid delivered to the cold sink;

wherein each of the cold sink and the heat exchanger is disposed to receive a liquid form of the working fluid from the separator.

2. The cooling system of claim 1, wherein the liquid loop further comprises a second fluid metering element disposed in a fluid line fluidly coupling the heat exchanger inlet and the pump outlet, the second fluid metering element configured to meter a flow of the working fluid delivered to the heat exchanger.

3. The cooling system of claim 2, wherein at least one of the first and second fluid metering elements is an electronically controlled valve.

4. The cooling system of claim 1, wherein the vapor compression cycle loop comprises a compressor, the compressor fluidly coupled to a heat exchanger outlet and the separator outlet to receive a vapor form of the working fluid from each of the heat exchanger and the separator.

5. The cooling system of claim 4, wherein the heat exchanger is configured to provide thermal communication between the working fluid in the liquid loop and the working fluid in the vapor compression cycle loop.

6. The cooling system of claim 5, wherein the vapor compression cycle loop further comprises:

a condenser disposed downstream of the compressor; and an expansion valve disposed downstream of the condenser and upstream of the separator;

wherein the heat exchanger is disposed between the condenser and the expansion valve and configured to place the working fluid received from the condenser in thermal communication with the working fluid received from the pump.

7. The cooling system of claim 4, wherein the vapor compression cycle loop further comprises:

a condenser disposed downstream of the compressor; and an expansion valve disposed downstream of the condenser and upstream of the separator;

wherein the heat exchanger is configured to place the working fluid received from the pump in thermal communication with a heat load external to the vapor compression cycle loop.

8. The cooling system of claim 7, wherein the heat exchanger is an evaporator.

9. The cooling system of claim 4, wherein the working fluid comprises a refrigerant and a lubricant.

10. The cooling system of claim 9, wherein the separator is configured to preferentially separate the lubricant from the vapor form of the working fluid and deliver the lubricant in the liquid form of the working fluid to the liquid loop.

11. The cooling system of claim 10, wherein each of the heat exchanger and the cold sink are arranged to receive a portion of the working fluid from the pump.

12. The cooling system of claim 10, wherein the heat exchanger is configured to place the working fluid received from the pump in thermal communication with a heat sink to vaporize the working fluid received from the pump.

13. A method of recovering a lubricant in a hybrid vapor compression cooling system, the method comprising:

separating, by a separator, a vapor form of a working fluid from a liquid form of a working fluid, wherein the working fluid comprises the lubricant and wherein the lubricant is preferentially separated with the liquid form of the working fluid;

delivering the liquid form of the working fluid from the separator to a liquid loop, the liquid loop comprising a pump and a cold sink fluidly coupled in flow series, the pump disposed in fluid communication between a separator outlet and each of a cold sink inlet and a heat exchanger inlet, the cold sink disposed in fluid communication with a separator inlet;

delivering the vapor form of the working fluid from the separator to a vapor compression cycle loop, the vapor compression cycle loop fluidly coupled to the liquid loop by the separator and comprising a compressor, a condenser, and an expansion valve fluidly coupled in flow series, the expansion valve fluidly coupled to a separator inlet;

delivering a first portion of the working fluid in the liquid loop to the cold sink; and delivering a second portion of the working fluid in the liquid loop to the vapor compression cycle loop, wherein delivering the second portion of the working fluid to the vapor compression cycle loop comprises delivering the second portion of the working fluid to a heat exchanger upstream of the compressor of the vapor compression cycle loop;

wherein a first fluid metering element is disposed in a fluid line fluidly coupling the cold sink inlet and a pump outlet, the first fluid metering element configured to meter a flow of the working fluid delivered to the cold sink; and wherein each of the cold sink and the heat exchanger is disposed to receive a liquid form of the working fluid from the separator.

14. The method of claim 13, wherein the heat exchanger places the second portion of the working fluid in thermal communication with a heat load to vaporize the second portion of the working fluid.

15. The method of claim 14, wherein the heat exchanger places the second portion of the working fluid in thermal communication with working fluid received from the condenser of the vapor compression cycle loop to vaporize the second portion of the working fluid.

16. The method of claim 15, controlling a volume of the second portion of the working fluid based on a lubricant load and a predetermined lubricant demand for operation of the compressor.

17. A cooling system comprising:

a liquid loop comprising a cold sink for cooling a heat load;

a vapor compression cycle loop fluidly coupled to the liquid loop by a separator, the vapor compression cycle loop comprising:

a compressor;

a condenser disposed downstream of the compressor; and an expansion valve disposed downstream of the condenser and upstream of the separator;

wherein the separator is configured to separate a two-phase form of a working fluid received from the cold sink into a vapor form of the working fluid and a liquid form of the working fluid; and a heat exchanger in fluid communication with each of the liquid loop and the vapor compression cycle loop and configured to provide thermal communication between the working fluid in the liquid loop and the working fluid in the vapor compression cycle loop, the heat exchanger disposed between the condenser and the expansion valve and configured to place the working fluid received from the condenser in thermal communication with the working fluid received from the separator via a pump;

wherein the compressor is fluidly coupled to a heat exchanger outlet and a separator outlet to receive the vapor form of the working fluid from each of the heat exchanger and the separator.

18. The cooling system of claim 17, wherein the working fluid comprises a refrigerant and a lubricant and wherein the separator is configured to preferentially separate the lubricant from the vapor form of the working fluid and deliver the lubricant in the liquid form of the working fluid to the liquid loop.

19. The cooling system of claim 18, wherein each of the heat exchanger and the cold sink are arranged to receive a portion of the working fluid from the pump.

20. The cooling system of claim 18, wherein the heat exchanger is configured to place the working fluid received from the pump in thermal communication with a heat sink to vaporize the working fluid received from the pump.

* * * * *